US006684774B2

(12) United States Patent
Wadlinger et al.

(10) Patent No.: US 6,684,774 B2
(45) **Date of Patent: *Feb. 3, 2004**

(54) SHEET-FED ROTARY PRINTING PRESS

(75) Inventors: Ralf Wadlinger, Ludwigshafen (DE); Rudolf Leib, Wiesloch (DE); Günter Stephan, Wiesloch (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 61 days.

This patent is subject to a terminal disclaimer.

(21) Appl. No.: 09/861,764

(22) Filed: May 21, 2001

(65) Prior Publication Data

US 2003/0205153 A1 Nov. 6, 2003

Related U.S. Application Data

(63) Continuation-in-part of application No. 09/075,794, filed on May 11, 1998, now Pat. No. 6,308,620, and a continuation-in-part of application No. 09/335,366, filed on Jun. 17, 1999, now Pat. No. 6,286,425.

(30) Foreign Application Priority Data

May 9, 1997 (DE) ..... 197 19 624
Jun. 17, 1998 (DE) ..... 198 26 891

(51) Int. Cl.[7] ..... B41F 13/193; B41F 13/08

(52) U.S. Cl. ..... 101/216; 101/217; 101/218; 101/409; 101/410

(58) Field of Search ..... 101/216, 217, 101/218, 247, 408, 409, 475, 420, 137, 410

(56) References Cited

U.S. PATENT DOCUMENTS

| | | | | |
|---|---|---|---|---|
| 3,190,218 A | | 6/1965 | Willard | 101/247 |
| 3,461,798 A | | 8/1969 | Bulk et al. | 101/184 |
| 3,592,136 A | | 7/1971 | Selman | 101/425 |
| 3,642,274 A | | 2/1972 | Herrington et al. | 271/186 |
| 3,703,863 A | * | 11/1972 | Giuiuzza | 101/183 |
| 3,800,698 A | | 4/1974 | Kist et al. | 101/137 |
| 3,926,118 A | | 12/1975 | Preuss | 101/246 |
| 4,014,260 A | | 3/1977 | Schroter-Dommes et al. | 101/212 |
| 4,204,471 A | | 5/1980 | Becker | 101/410 |
| 4,217,824 A | | 8/1980 | Rebel et al. | 101/375 |
| 4,280,406 A | | 7/1981 | Corse | 101/177 |
| 4,395,949 A | | 8/1983 | Jeschke | 101/420 |
| 4,414,896 A | * | 11/1983 | Fischer | 101/184 |

(List continued on next page.)

FOREIGN PATENT DOCUMENTS

| | | |
|---|---|---|
| DE | 32 20 364 C2 | 12/1983 |
| DE | 39 26 088 C1 | 10/1990 |
| DE | 41 38 278 A1 | 5/1993 |
| DE | 43 18 777 A1 | 12/1994 |
| DE | 43 18 777 C2 | 12/1994 |
| DE | 44 43 493 A1 | 6/1996 |
| DE | 195 37 421 C1 | 3/1997 |
| DE | 196 27 478 C2 | 1/1998 |
| DE | 197 19 624 C1 | 6/1998 |
| EP | 0 165 477 A1 | 12/1985 |
| EP | 0 306 682 B1 | 3/1989 |
| FR | 806.874 | 12/1936 |
| GB | 466305 | 5/1937 |
| WO | WO 90/15671 | 12/1990 |

*Primary Examiner*—Daniel J. Colilla
(74) *Attorney, Agent, or Firm*—Laurence A. Greenberg; Werner H. Stemer; Ralph E. Locher

(57) ABSTRACT

A sheet-fed rotary printing press has at least one unit which includes an impression cylinder and an additional cylinder assigned to the impression cylinder. The impression cylinder and the additional cylinder are relatively adjustable a spaced distance from one another. A sheet guiding device is disposed on the additional cylinder for keeping sheets of printing material, which have been transported by the impression cylinder past the additional cylinder, away from the additional cylinder, once the spaced distance between the impression cylinder and the additional cylinder has been set.

47 Claims, 15 Drawing Sheets

U.S. PATENT DOCUMENTS

| | | | | | |
|---|---|---|---|---|---|
| 4,552,069 | A | | 11/1985 | Jahn | 101/420 |
| 4,688,784 | A | | 8/1987 | Wirz | 271/195 |
| 4,721,041 | A | * | 1/1988 | Simeth | 101/230 |
| 4,905,595 | A | | 3/1990 | Jeschke | 101/174 |
| 4,934,305 | A | | 6/1990 | Koehler et al. | 118/46 |
| 4,973,040 | A | | 11/1990 | Kemp et al. | 271/277 |
| 5,081,927 | A | | 1/1992 | Jahn | 101/218 |
| 5,088,404 | A | | 2/1992 | MacConnell et al. | 101/232 |
| 5,115,740 | A | | 5/1992 | Emrich et al. | 101/420 |
| 5,178,678 | A | | 1/1993 | Koehler et al. | 118/46 |
| 5,186,107 | A | | 2/1993 | Wieland | 101/409 |
| 5,228,390 | A | | 7/1993 | Jahn | 101/352.05 |
| 5,456,178 | A | | 10/1995 | Henn et al. | 101/407.1 |
| 5,564,692 | A | | 10/1996 | Lotsch et al. | 271/195 |
| 5,649,482 | A | | 7/1997 | Hummel et al. | 101/218 |
| 5,678,486 | A | | 10/1997 | Bachmeir et al. | 101/409 |
| 5,836,247 | A | | 11/1998 | Stephan et al. | 101/420 |
| 5,927,203 | A | | 7/1999 | Gieser et al. | 101/419 |
| 5,983,793 | A | | 11/1999 | Volz et al. | 101/216 |
| 6,308,620 | B1 | * | 10/2001 | Wadlinger et al. | 101/183 |

* cited by examiner

SHEET-FED ROTARY PRINTING PRESS

CROSS-REFERENCE TO RELATED APPLICATIONS

This application is a continuation-in-part of application Ser. No. 09/075,794, now U.S. Pat. No. 6,308,620, filed May 11, 1998 and of application Ser. No. 09/335,366, now U.S. Pat. No. 6,286,425, filed Jun. 17, 1999.

BACKGROUND OF THE INVENTION

Field of the Invention

The invention relates to a sheet-fed rotary printing press having at least one unit which includes an impression cylinder and an additional cylinder assigned to the impression cylinder, the impression cylinder and the additional cylinder being relatively adjustable a spaced distance from one another.

In multicolor sheet-fed rotary printing presses, downline from which a varnishing unit is disposed, the transported sheets are printed with ink only in the initial printing units during the printing operation. Downline printing and varnishing units, respectively, are in an idling mode wherein the rubber blanket cylinder and the varnish blanket cylinder, respectively, are disengaged from the printing cylinder. A small gap is formed therebetween, through which the previously printed sheets are transported. Because of the high press speed, the sheets lift away from the respective printing cylinder, so that the freshly applied ink comes into contact with the rubber blanket or varnish blanket and smears.

The published German Patent Document DE 43 18 777 C2 shows a printing unit of a sheet-fed rotary printing press, wherein devices for aiding or promoting sheet guidance are provided, in order to avoid, respectively, smearing of and damage to the freshly printed image. The provisions taken in the heretofore known devices, however, are not always effective because, for example, in a rear region of the sheet, contact of the sheet end with the rubber blanket or the varnish blanket cylinder occurs, nevertheless, when the printing is performed on stiff sheet material.

SUMMARY OF THE INVENTION

In view of the aforementioned prior art, it is an object of the invention of the instant application to provide a sheet-fed rotary printing press which enables smear-free sheet travel when the printing, varnishing or finishing units are shut down.

With the foregoing and other objects in view, there is provided, in accordance with the invention, a sheet-fed rotary printing press having at least one unit including an impression cylinder and an additional cylinder assigned to the impression cylinder, the impression cylinder and the additional cylinder being relatively adjustable a spaced distance from one another, a sheet guiding device disposed on the additional cylinder for keeping sheets of printing material, which have been transported by the impression cylinder past the additional cylinder, away from the additional cylinder, once the spaced distance between the impression cylinder and the additional cylinder has been set.

In accordance with another feature of the invention, the additional cylinder is stoppable, so that it will not rotate while the impression cylinder rotates.

In accordance with a further feature of the invention, the sheet-fed rotary printing press includes a clutch via which the additional cylinder is decouplable from a printing-press drive for driving the additional cylinder.

In accordance with an added feature of the invention, the additional cylinder is formed with a cylinder gap approximately alignable with the impression cylinder in a stopped condition of the additional cylinder, for setting the spaced distance between the additional cylinder and the impression cylinder.

In accordance with an additional feature of the invention, the sheet-fed rotary printing press includes a detent for fixing the additional cylinder relative to a printing-press frame, in a position of the additional cylinder wherein the cylinder gap formed therein is in alignment with the impression cylinder, and in a condition wherein the additional cylinder is decoupled from a printing-press drive for driving the additional cylinder.

In accordance with an alternative feature of the invention, the sheet-fed rotary printing press includes a blast air connection for fixing the additional cylinder relative to a printing-press frame, in a position of the additional cylinder wherein the cylinder gap formed therein is in alignment with the impression cylinder, and in a condition wherein the additional cylinder is decoupled from a printing-press drive for driving the additional cylinder.

In accordance with yet another feature of the invention, the sheet guiding device includes at least one sheet guiding element secured to the additional cylinder.

In accordance with another feature of the invention, the additional cylinder has a displaceable outer portion; and the sheet guiding element is disposed at the displaceable outer portion. In particular, the sheet guiding element may be embodied as a surface of the displaceable outer portion.

In accordance with yet another feature of the invention, the additional cylinder is stoppable in a position wherein the displaceable outer portion thereof is disposed opposite the impression cylinder.

In accordance with yet another feature of the invention, the displaceable outer portion of the additional cylinder has a clamping device for a cylinder covering to be mounted on the additional cylinder.

In accordance with another feature of the invention, the displaceable outer portion of the additional cylinder forms part of a circular outer surface of the additional cylinder.

In accordance with yet a further feature of the invention, the displaceable outer portion of the additional cylinder is removably fastened to the additional cylinder.

In accordance with yet another feature of the invention, the displaceable outer portion of the additional cylinder is displaceable into an interior of the additional cylinder.

In accordance with another feature of the invention, the displaceable outer portion of the additional cylinder is mounted so as to be pivotable about an axis aligned parallel to an axis of rotation of the additional cylinder.

In accordance with yet another feature of the invention, the sheet guiding element is an outwardly pivotable sheet guiding element.

In accordance with a further feature of the invention, the sheet guiding element is formed with a surface which, when in an outwardly displaced position, extends concentrically with a surface of the impression cylinder.

In accordance with yet another feature of the invention, the displaceable outer portion of the additional cylinder is displaceable linearly in a direction towards the interior of the additional cylinder.

In accordance with yet a further feature of the invention, the sheet guiding element is formed as at least one guide tongue.

In accordance with an alternative feature of the invention, the sheet guiding element is formed as at least one small wheel.

In accordance with another alternative feature of the invention, the sheet guiding element is formed as at least one blast tube.

In accordance with yet a further feature of the invention, the blast tube is couplable to a blast air connection at an end face of the additional cylinder.

In accordance with yet an added feature of the invention, the additional cylinder is formed with a cylinder gap, and the sheet guiding element being received in the cylinder gap.

In accordance with yet an additional feature of the invention, at least one cylinder of the impression cylinder and the additional cylinder is constructed so as to be engageable with and disengageable from the other for setting the spaced distance between the impression cylinder and the additional cylinder.

In accordance with still another feature of the invention, the sheet-fed rotary printing press includes a cylinder covering or liner on the additional cylinder, the cylinder covering being removable from the additional cylinder for setting the spaced distance between the impression cylinder and the additional cylinder.

In accordance with still a further feature of the invention, the impression cylinder and the additional cylinder, between which the spaced distance is set, are rotatable in common with one another, while the sheet guiding device acts upon the sheet to be printed.

In accordance with still an added feature of the invention, the sheet guiding device includes blast air nozzles disposed on the circumferential surface of the additional cylinder.

In accordance with still an additional feature of the invention, the additional cylinder has a stationary cylinder core formed with a chamber chargeable with blast air, and an outer casing rotatable about the stationary cylinder core, the outer casing having blast air ducts leading to the blast air nozzles.

In accordance with another feature of the invention, the sheet-fed rotary printing press includes a rotary valve assigned to the additional cylinder and, upon rotation of the additional cylinder, intermittently subjecting the rotating blast air nozzles to blast air whenever the blast air nozzles are directed generally towards the impression cylinder.

In accordance with a further feature of the invention, the at least one unit is a printing unit, and the additional cylinder is a cylinder for printing on the sheet to be printed.

In accordance with an alternative feature of the invention, the at least one unit is a varnishing unit, and the additional cylinder is a cylinder for varnishing the sheet to be printed.

In accordance with another alternative feature of the invention, the at least one unit is a finishing unit, and the additional cylinder is a processing cylinder having a circumference occupied by tools for processing the sheet to be printed.

In accordance with a concomitant feature of the invention, the at least one unit is disposed downline from at least one printing unit of the sheet-fed rotary printing press, as viewed in a sheet transport direction therethrough.

Preferably, the sheet guiding device forces the sheet to be printed approximately in the direction of the impression cylinder.

In accordance with another feature of the invention, a first electric motor is drive-connected to the impression cylinder for rotating the impression cylinder; and a second electric motor is drive-connected to the additional cylinder for rotating the additional cylinder.

In accordance with yet another feature of the invention, an electronic control device is connected to the first and second electrical motors; and the electronic control device controls the first electric motor such that the first electric motor rotates the impression cylinder with a first circumferential surface speed, and the electronic control device controls the second electric motor such that the second electric motor simultaneously rotates the additional cylinder with a second circumferential surface speed equal to the first circumferential surface speed.

In accordance with a further feature of the invention, a current circuit including an integrated breaker for interrupting the current circuit is provided; and the additional cylinder and the impression cylinder is controlled such that, when the breaker interrupts the current circuit, the additional cylinder is shut down and stopped while the impression cylinder rotates.

Preferred embodiments of the invention are based on the realization that it is markedly simpler to avoid smearing if the nip between the first cylinder, i.e., the impression cylinder, and the second cylinder, i.e., the rubber blanket or varnishing blanket cylinder, for example, that is associated therewith, is enlarged or widened beyond the extent that is predefined when the cylinders are disengaged or brought out of contact. This is preferably performed by stopping the second cylinder, i.e., the rubber blanket or varnishing blanket cylinder, and, if necessary, after removing the rubber blanket or varnishing blanket, displacing a segment or portion of the cylinder. This displacement may be performed by removing the relevant portion and the relevant segment of the cylinder, respectively, i.e., disassembled or simply displaced into the interior of the cylinder, which is particularly expedient. This can be effected by appropriately rotating the aforementioned segment and portion of the cylinder, respectively, or by a linear movement which displaces the segment away from the impression cylinder into the interior of the rubber blanket and varnishing blanket cylinder, respectively. During subsequent printing, this further rubber blanket and varnishing blanket cylinder, respectively, remains uncoupled from the drive of the printing machine, for example, by a clutch, in a position wherein the removed or displaced segment is located opposite the impression cylinder. In this way, the distance between the impression cylinder, on the one hand, and the rubber blanket and varnishing blanket cylinder, respectively, on the other hand, can be enlarged or widened to such an extent that the risk of smearing is reduced considerably or is largely avoided, depending upon the printing speed and the stiffness of the printing material.

It is advantageous if, for this purpose, the clamping device or devices needed for clamping the rubber and varnishing blanket, respectively, in the cylinder gap of the relevant cylinder are displaced, these installed cylinder-gap fittings either being removed or, what is particularly expedient, being pivoted into the interior of the cylinder about an axis parallel to the cylinder axis. This is because the latter measure can be performed rapidly and simply, when provided with a suitable design, and, if necessary, can also be automated.

Other features which are considered as characteristic for the invention are set forth in the appended claims.

Although the invention is illustrated and described herein as embodied in a sheet-fed rotary printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 8 is a greatly diagrammatic, side elevational view, in profile, of a full sheet-fed rotary printing machine of which FIG. 1 is only a fragment.

DESCRIPTION OF THE PREFERRED EMBODIMENTS

Figure 1:
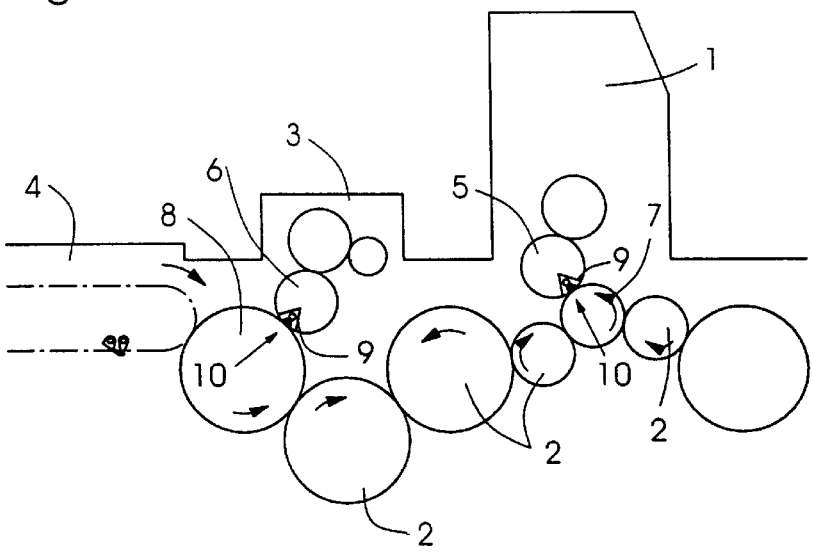
FIG. 1 is a fragmentary diagrammatic side elevational view of a sheet-fed rotary printing press wherein printing and varnishing units have been shut down or stopped.
Figure 3:
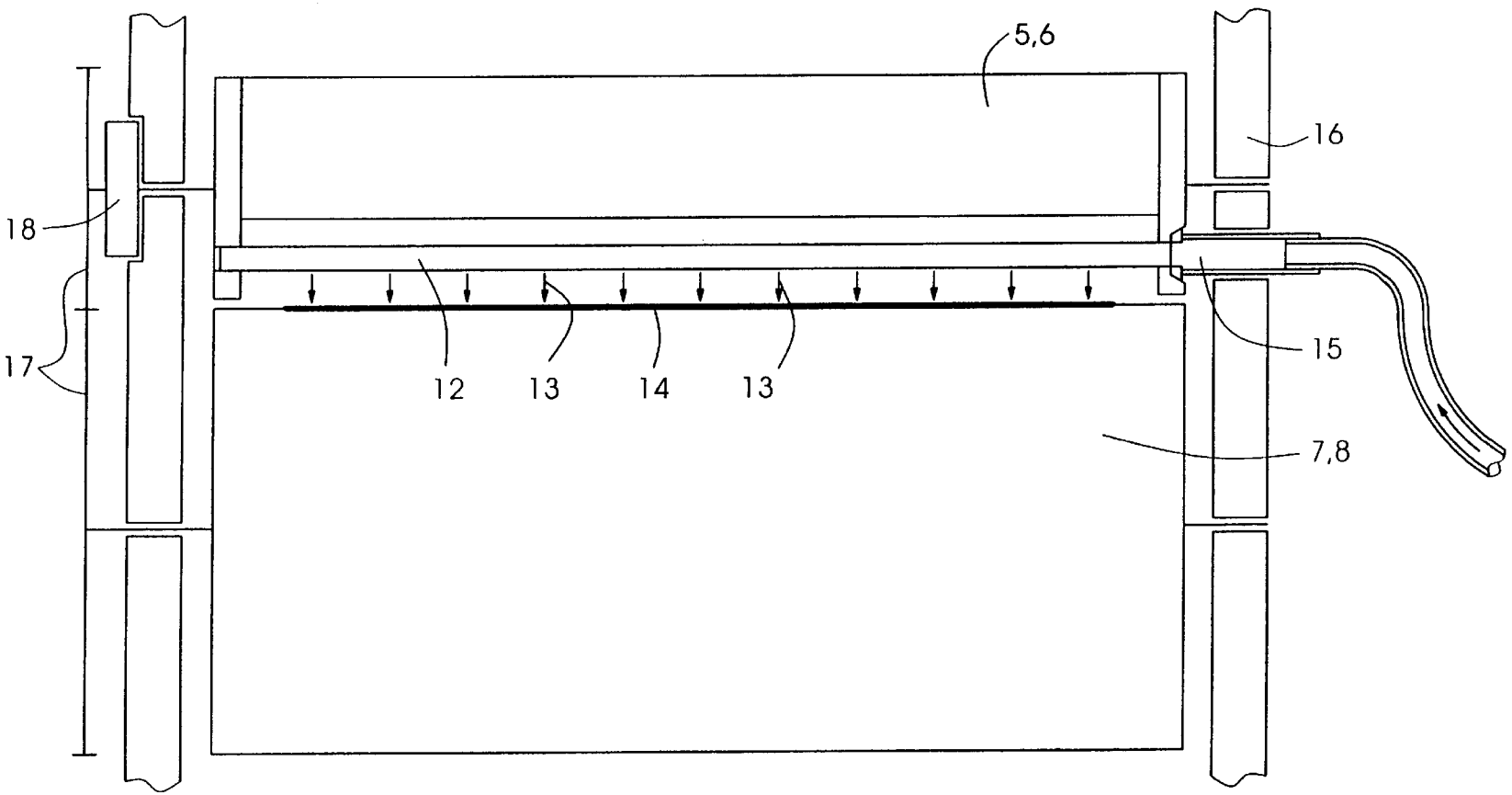
FIG. 3 is a fragmentary, diagrammatic, longitudinal sectional view of the sheet guiding device.

Referring now to the drawings and, first, particularly to FIG. 1 thereof, there is shown therein a sheet-fed rotary printing press having a rubber blanket cylinder 5 and a varnish blanket cylinder 6 separated from a press drive mechanism 17 by a clutch 18 (FIG. 3, for example). The cylinders 5 and 6, respectively, are formed with cylinder gaps 9 oriented opposite to respective impression cylinders 7 and 8, the rubber blanket cylinder 5 and the varnish blanket cylinder 6 being fixed in this position. Sheet guiding elements 10 are provided in the cylinder gaps 9. With this construction according to the invention, in the region of the cylinder gap 9, the spacing or spaced distance to the jacket surface of the respective printing cylinders 7 and 8 is increased, so that a considerably greater clearance or interspace is provided for transporting the sheets. By disposing the sheet guiding elements 10 in the cylinder gaps 9, smear-free transport of the sheets can be improved further yet so that even the ends of the sheets cannot become smeared. With this construction in accordance with the invention, the spacing between the two cylinders of the prior art device is increased many times.

Figure 8:
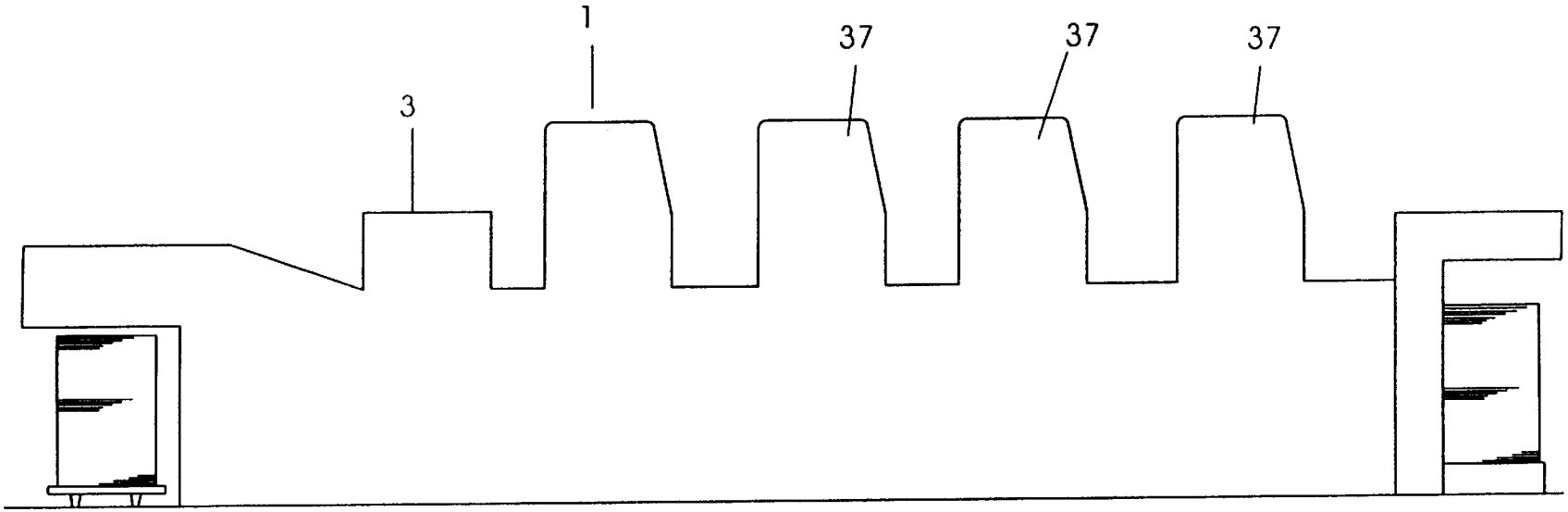

FIG. 1 illustrates part of a multicolor sheet-fed rotary printing press, wherein sheets, which have already been printed by printing units 37, as shown in FIG. 8, are then fed to a printing unit 1 which does not take part in the printing of the sheets. The printed sheets are transported from the printing unit 1 by transfer drums 2 through a varnishing unit 3, which also does not take part in the printing of the sheets, and are then fed to a sheet delivery 4. The rubber blanket cylinder 5 and the varnish blanket cylinder 6 are disengaged from the respective printing cylinders 7 and 8. The rubber blanket cylinder 5 and the varnish blanket cylinder 6 are formed with respective cylinder gaps 9, wherein suitable blanket fasteners are provided in a conventional manner and wherein drive wheels are provided on the axle journals of the cylinders.

In the cylinder gaps 9 of the rubber blanket cylinder 5 and the varnish blanket cylinder 6, there are provided sheet guiding elements 10 which may be embodied as guide baffles or guide tongues 11. The guide baffles/guide tongues 11 can be inserted into the cylinder gaps 9 and fastened or otherwise secured therein. Consequently, when stiff cardboard is printed, for example, the rear or trailing edge of the cardboard sheet can slide along the guide baffles/guide tongues 11 without damaging the imprint.

An advantageous construction in accordance with the invention is that of embodying the sheet guide elements 10 as blast or blow tubes 12, which are couplable to blown or blast air connections on an end face of the respective cylinder 5, 6. The blow tubes 12 can thus emit a vertical air flow or current onto the sheets to be transported, thereby achieving maximum contact pressure. The blast air 13 of the blow tubes 12 is directed vertically towards the sheets transported by the respective impression cylinders 7 and 8, so that the sheets are pressed down onto the respective impression cylinders 7 and 8 without coming into contact with any parts of the rubber blanket cylinder 5 or varnish blanket cylinder 6. By the mere use of these blast or blow tubes 12 alone, respective smearing and lifting away of the printed sheets is prevented. The guide tongues 11 may be provided in addition to the blast air 13 and the blast or blow tube 12, respectively, so that even when cardboard is being processed, smearing of the printed image is avoided. The spacing between the guide tongues 11 and the jacket surface of the respective impression cylinder 7, 8 is increased considerably, which again aids in or supports the smear-free transport of the sheets.

The further advantageous embodiment of the invention shown in FIG. 3 includes the feature of the rubber blanket cylinder 5 and the varnishing blanket cylinder 6, in the decoupled condition thereof, being fixable relative to a press side frame 16 via blast or blown air connections 15 and detents 19. By the insertion of the blast or blown air connections 15, the cylinders can be fixed in position via a seal. Independently thereof, the detents 19 can also be used, the detents 19 locking into place in the stopped cylinder and assuring the fixation thereof.

Figure 4:
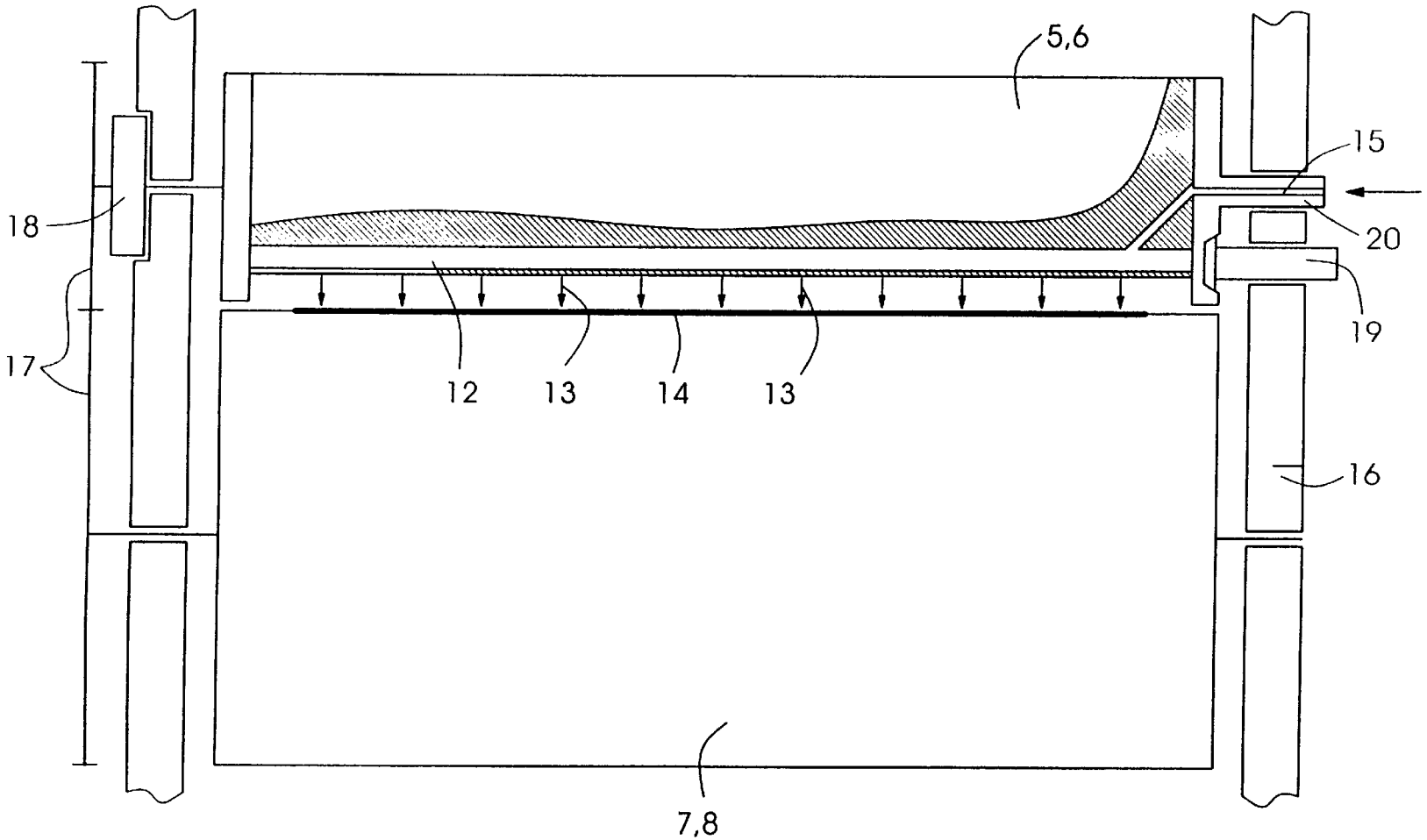
FIG. 4 is a view like that of FIG. 3 of another embodiment of the invention, showing one of the cylinders partly in section and provided with an integral blow tube.

FIG. 3 is a longitudinal view of the blow tube 12, showing a printed sheet 14 being transported on the jacket surface of the respective impression cylinder 7, 8 and being held down by blast or blown air 13 emerging from the blast or blow tube 12. The latter is supported in the rubber blanket cylinder 5 and varnish blanket cylinder 6, respectively, and is couplable to the end face of the cylinder with a blast or blown air connection 15. By inserting the blast or blown air connection 15, the rubber blanket cylinder 5 and the varnish blanket cylinder 6, respectively, are fixable in the decoupled position thereof relative to a press side frame 16. Alternatively, a detent 19 (FIG. 4) may be provided for fixation purposes between the respective rubber blanket cylinder 5 and varnish blanket cylinder 6, on the one hand, and the press side frame 16, on the other hand. The blast air connection 15 may also be provided in a trunnion or axle journal 20 so that the blast air can be fed to the blow tube 12 inside the cylinder 5, 6.

Figure 2:
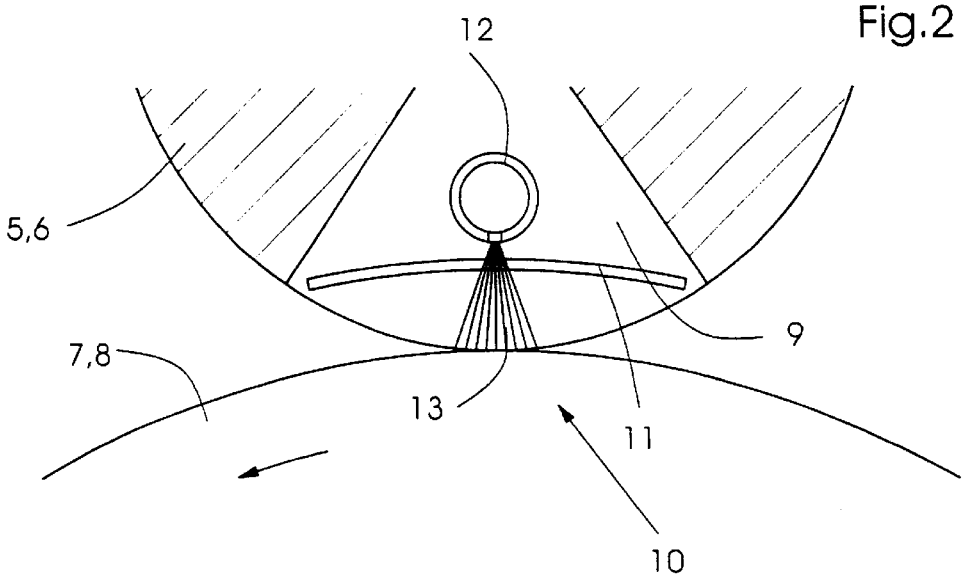
FIG. 2 is an enlarged fragmentary cross-sectional view of FIG. 1 showing one of the cylinders of the press formed with a cylinder gap having a sheet guiding element disposed therein.

Both the rubber blanket cylinder 5 and the varnish blanket cylinder 6 are disconnectable or separable from the printing-press drive 17 via a respective clutch 18, so that the cylinder gaps 9 are directed towards the respective printing cylinder 7, 8, as shown in FIG. 1 and FIG. 2, for example. The rubber blanket cylinder 5 and the varnish blanket cylinder 6 are fixed in this position, so that the printing press can continue production with the upline printing units thereof without hindrance.

Figure 5:
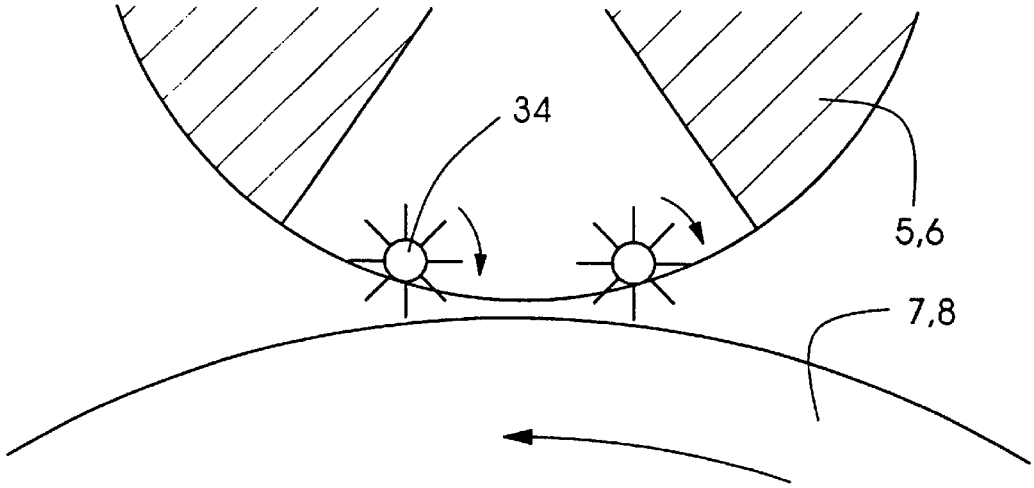
FIG. 5 is a view like that of FIG. 2 of a further embodiment of the invention which has a different sheet guiding device.

FIG. 5 shows a modification of the embodiment of the invention illustrated in FIG. 2. In addition to or in combination with the sheet guiding element 10 shown in FIG. 2, small wheels 34 formed as tail wheels are rotatably secured to the cylinder 5, 6. The small wheels 34 are adjustable in the axial direction of the cylinder 5, 6 and can preferably be set on elongated corridors of the sheet 14 that are free of any printed image. The wheels 34 can also roll off in the region of the printed image, virtually precluding any smearing of the fresh printing ink. For one, the wheels 34 can be rotated by the printed sheets 14 in contact therewith, so that no relative motion, which leads to smearing, can take place between the printed sheets 14 and the wheels 34. For another, the wheels 34 with their needlelike points have only minimal point contact with the printed sheets 14.

Figure 6:
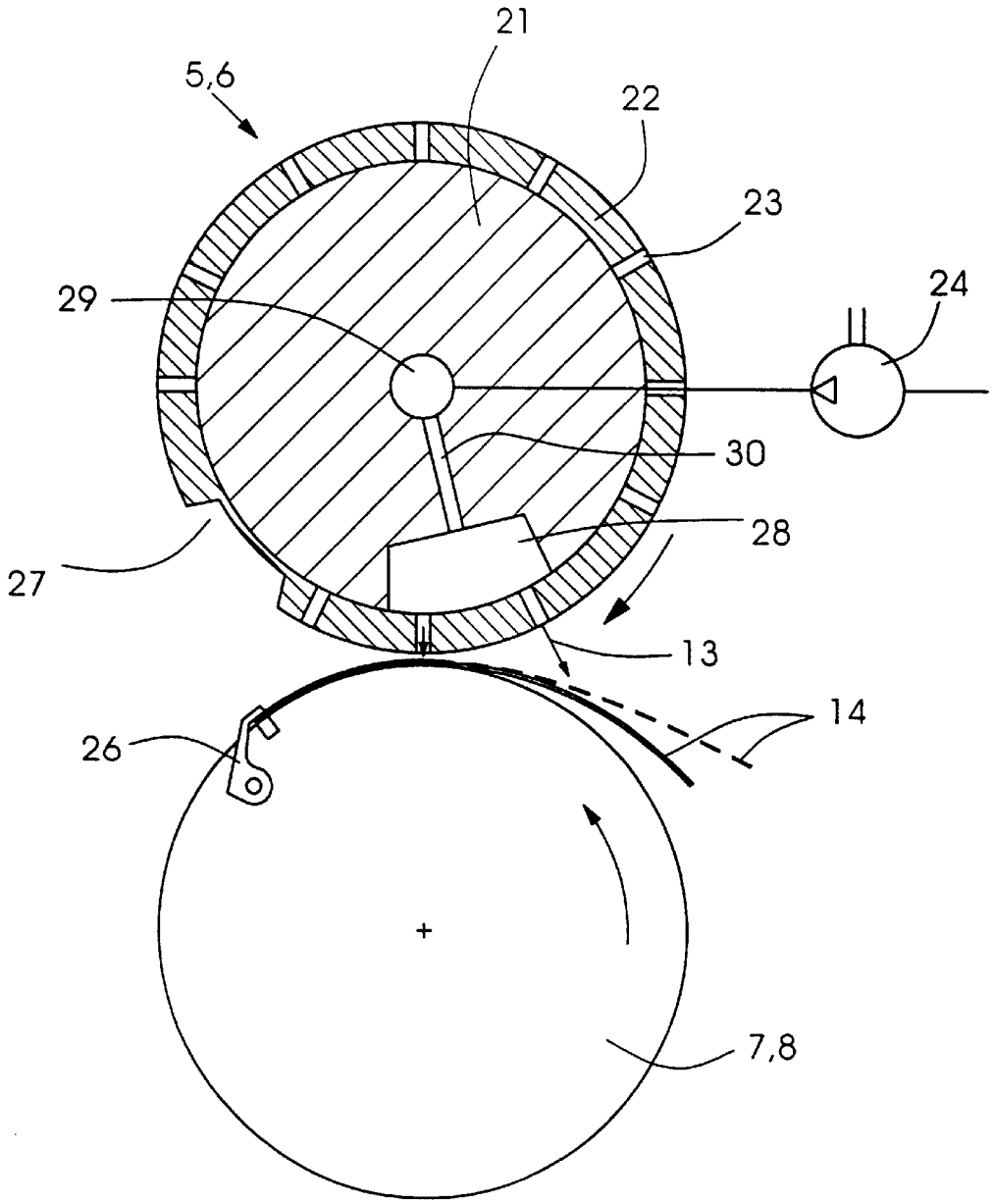
FIG. 6 is an enlarged fragmentary cross-sectional view of FIG. 1 of an added embodiment of the invention.

In FIG. 6, a further embodiment of the invention is illustrated which differs from the embodiments described in conjunction with the preceding figures of the drawings in that the additional cylinder 5, 6 is not shut down or stopped, but rather, rotates as well while the sheet 14 to be printed is fed past the additional cylinder 5, 6 by the respective impression cylinder 7, 8. An advantage derived therefrom is that relative motion between the circumferential surface of the additional cylinder 5, 6 and the sheet 14 to be printed is avoided, thereby avoiding smearing. This is important, for example, in the event that the blast or blown air nozzles 35, which force away the sheet 14 to be printed from the additional cylinder 5, 6, have not yet been activated, or that the blast or blown air pressure is set too low. The additional cylinder 5, 6, in the embodiment shown in FIG. 6, is constructed as a varnishing blanket or rubber blanket cylinder, just as in the preceding figures of the drawings described hereinabove. The spacing between the circumferential surfaces of the additional cylinder 5, 6, on the one hand, and the impression cylinder 7, 8, or the sheet 14 to be printed, which rests on the impression cylinder 7, 8, on the other hand, can be established or set by shifting the additional cylinder 5, 6 away from the impression cylinder 7, 8. The spacing can also be set or established by removing from the additional cylinder 5, 6, a cylinder liner or cylinder covering 36 (note FIG. 7), for example, a rubber blanket, which is required on the additional cylinder 5, 6 for the active use thereof, for example, for printing or varnishing, thereby also exposing the blast or blown air openings 35. As shown in FIG. 6, the blast or blown air openings 35 can be distributed uniformly in the circumferential and axial directions over the entire jacket surface of the additional cylinder 5, 6, and arranged in rows. The additional cylinder 5, 6 is of multipartite construction, a cylinder core 21 thereof being formed with a chamber 28, which is open on the outside thereof facing towards a casing 22. The chamber 28 can be supplied with compressed air from a blast or blown air source 24 via a central channel 29 and one or more radial channels 30. The chamber 28 may be an axially parallel channel extending over the entire length of the cylinder. The hollow-cylindrical casing 22 rotates about the cylinder core 21 and, as a result thereof, blown or blast air ducts 23 which terminate in the blast or blown air nozzles 35 (FIG. 7) intermittently coincide, on the inside, with the chamber 28, so that the blast or blown air can pass from the chamber 28 into the blast or blown air ducts 23 and can flow out of the respective blast or blown air nozzles 35 rotating past the chamber 28 at the time. The cylinder core 21 may be adjustable in the circumferential direction, so that the location of the chamber 28 is variable. For example, the chamber 28 can be adjusted so that it is aligned precisely with the center of the impression cylinder 7, 8 or somewhat in the direction of the entry or infeed gap where the sheet 14 to be printed enters between the cylinder 5, 6, on the one hand, and the cylinder 7, 8, on the other hand. Sheet guiding elements for keeping the sheet 14 to be printed mechanically spaced apart from the additional cylinder 5, 6, namely, for example, the guide tongues 11 or small wheels 34 shown in the figures of the drawings described hereinabove, are suitable particularly for heavy, stiff cardboard. Pneumatically acting sheet guiding devices, such as the blast or blow tube 12 and the blast or blown air nozzles 35 shown in FIG. 7, are especially well suited for lightweight papers.

Figure 7:
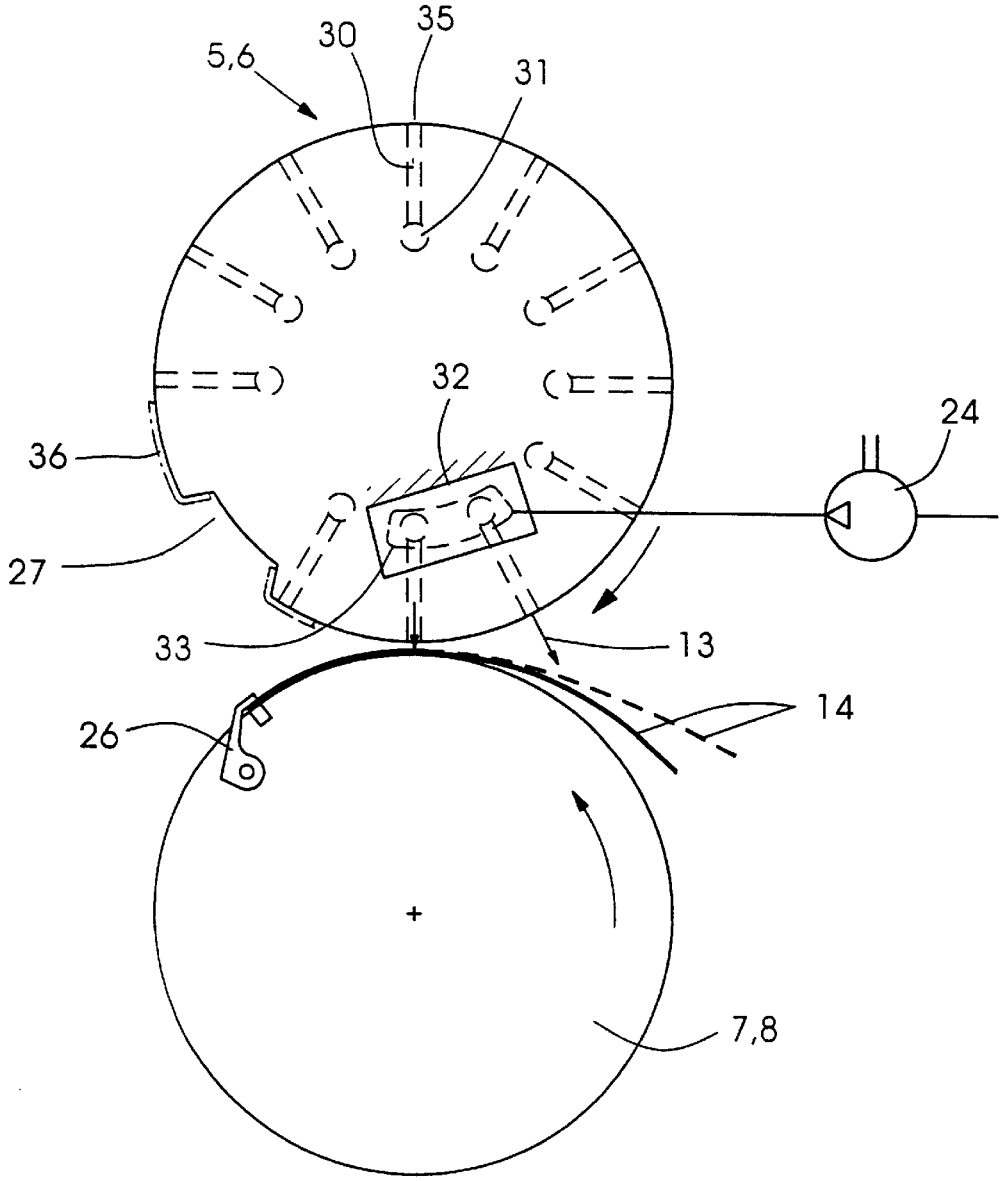
FIG. 7 is a view similar to that of FIG. 6 of an additional embodiment of the invention.

A further embodiment of the invention shown in FIG. 7 is a modification of the embodiment shown in FIG. 6. The additional cylinder 5, 6 is of unipartite construction in this embodiment and is formed with longitudinal channels 31 extending in an axially parallel direction, and radial channels 30 terminating in the blast or blown air nozzles 35 branch off from the longitudinal channels 31. The longitudinal channels 31 terminate at the end face of the cylinder. Upon rotation of the additional cylinder 5, 6, the longitudinal channel openings 31 intermittently coincide with a valve opening 33 of a rotary valve 32 disposed externally to the cylinder, for example, on the press side frame. The valve opening 33 facing towards the longitudinal channel openings 31 on the additional cylinder 5, 6 is part of a chamber of the rotary valve 32 that is acted upon by blown or blast air from the blown or blast air source 24. The blown or blast air emerges from the valve opening 33 and enters into the longitudinal channel opening 31 whenever or as long as the openings 31 and 33 coincide with one another. The openings 31 formed in the cylinder, and the opening 33 located externally to the cylinder are disposed so that, substantially in the region of the nip formed by the cylinder 5, 6, on the one hand, and the cylinder 7, 8, on the other hand, the blast or blown air nozzles 35 moving past are acted upon by blast or blown air, as has been described hereinbefore in conjunction with FIG. 6. In this manner, the sheet 14 to be printed, which is being conveyed by the impression cylinder 7, 8, is kept spaced apart from the additional cylinder 5, 6.

In FIG. 8, the printing press previously shown in part in FIG. 1 is shown again, printing units 37 disposed upline or upstream from the printing unit 1 and the varnishing unit 3, as viewed in the sheet transport direction, being also shown therein. Instead of or in addition to the varnishing unit 3, a finishing unit may be provided, which likewise has an impression cylinder 7, 8, however, this cylinder does not cooperate with a coating cylinder 5, 6 as in the case of the printing or varnishing units 1, 3, but rather with a processing cylinder. The processing cylinder, installed, for example, in place of the rubber blanket or varnishing blanket cylinder 5, 6, is furnished with tools. For example, a plate with stamping tools can be deployed on the processing cylinder. The processing cylinder may also be equipped on the circumference thereof with embossing, fluting or perforating tools, in order to permit finishing of the printed product after the printing has been performed by the printing units 37.

Figure 9:
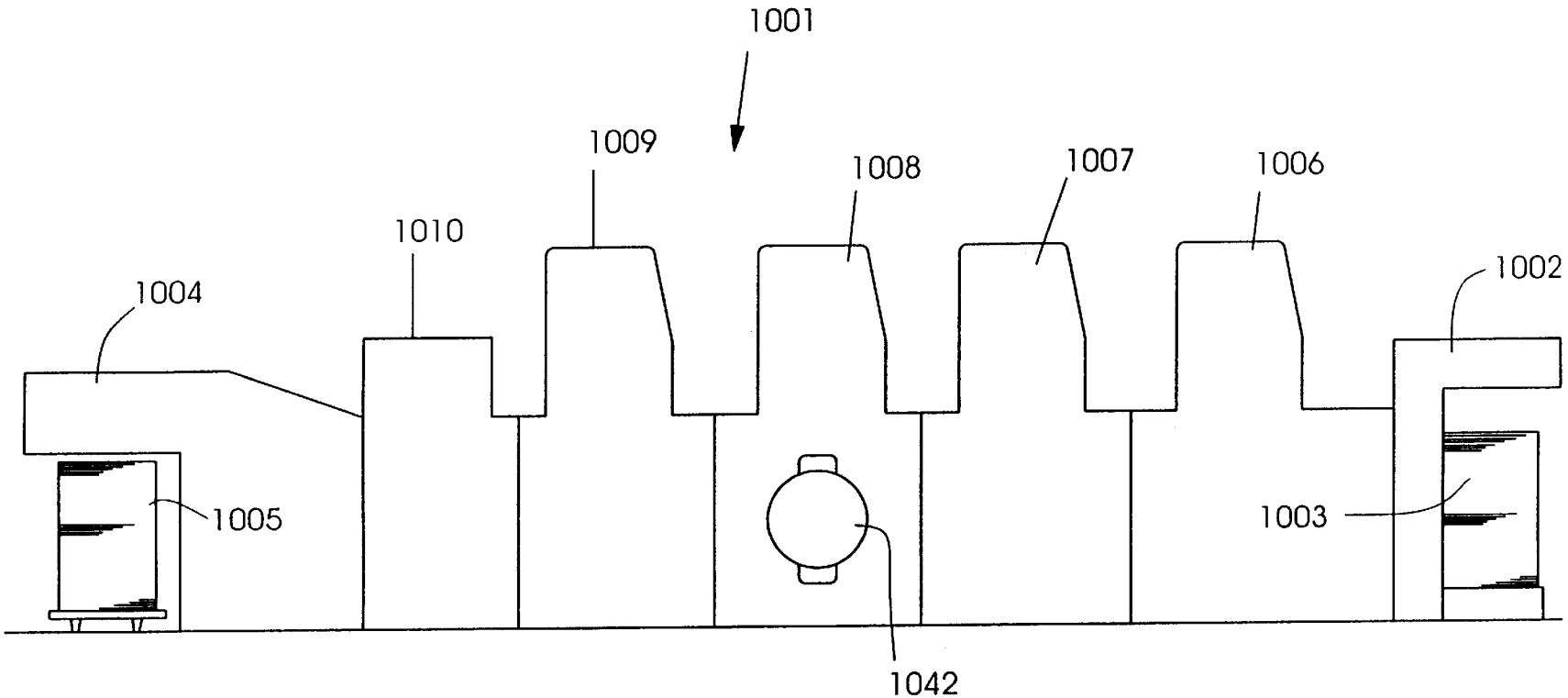
FIG. 9 is a diagrammatic side elevational view of a printing machine of unit construction having a plurality of printing units and a varnishing unit.

FIG. 9 shows, in diagrammatic form, a sheet-fed offset printing machine 1001 of unit or in-line construction. It has a feeder 1002, which is used to transport paper sheets from a pile 1003 into a first printing unit 1006. There, and in three succeeding printing units 1007, 1008 and 1009, the conveyed paper sheets are printed after one another with four colors and then pass into a varnishing unit 1010, where a varnish layer is applied over the entire surface of the sheets before they are deposited by a delivery 1004 on a delivery pile 1005 after passing through non-illustrated drying and powdering units.

The cylinders which transport the sheet in the printing units 1006 to 1009 and in the varnishing unit 1010 are connected to one another by a non-illustrated spur gear mechanism, and are driven jointly by a main drive motor 1042.

Figure 10:
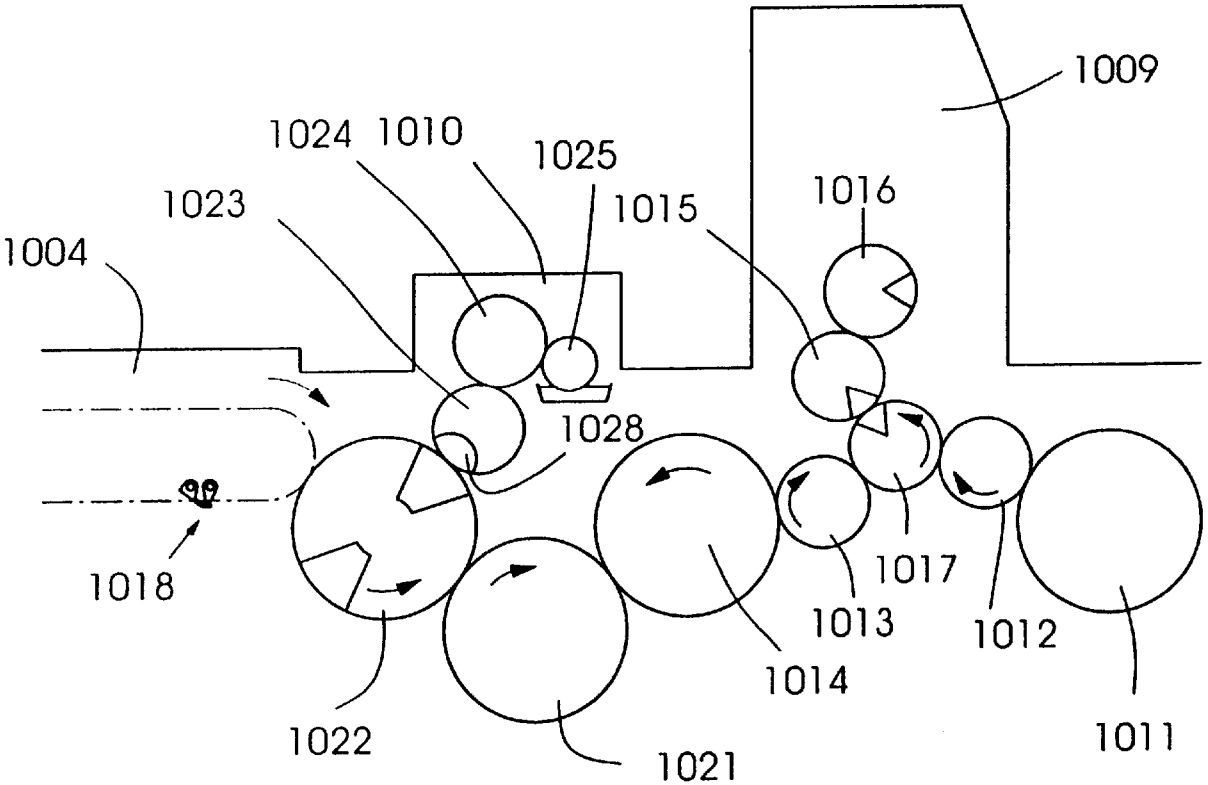
FIG. 10 is an enlarged fragmentary view of FIG. 9 showing the units 1009 and 1010 of the printing machine with cylinders used for paper transport and for printing, respectively.

As can be seen from the somewhat detailed view according to FIG. 10, the printing unit 1009 is an offset printing unit having a plate cylinder 1016 and a rubber blanket cylinder 1015, by which a sheet transported by transfer drums 1011 and 1012 and fed to an impression cylinder 1017 is then printed with ink. The inking unit, which is used to ink the printing plate on the plate cylinder 1016, is not illustrated in FIG. 10. The impression cylinder 1017 in the printing unit 1009 is followed by three further transfer cylinders 1013, 1014 and 1021, which transport the sheet onward and transfer it to the cin the varnishing unit 1010. There, the sheet is varnished over the entire surface thereof by a varnishing blanket that is clamped onto the varnishing blanket cylinder 1023, and is then transferred to a gripper bar 1018 on transport chains of the delivery 1004. The application of varnish to the varnishing blanket clamped onto the cylinder 1023 is performed by two rollers 1024 and 1025, the roller 1024 being an applicator roller and the roller 1025 being a dip roller running in a varnish trough. The width of the gap or nip between the two rollers 1024 and 1025 effects the metering of the quantity of varnish.

Figure 11A:
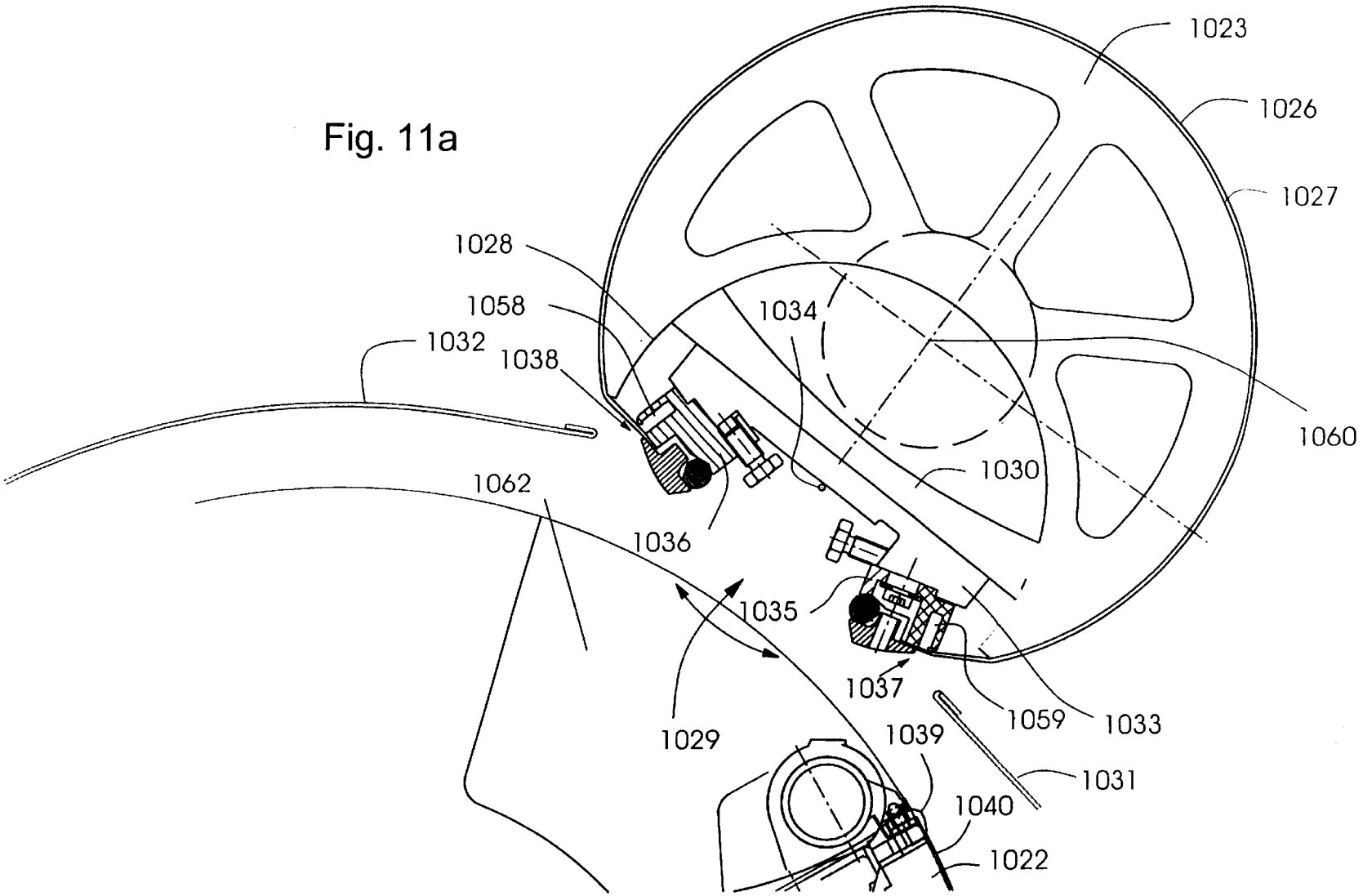
FIG. 11*a* is an enlarged fragmentary view of FIG. 10 showing in greater detail a first exemplary embodiment of a varnishing blanket cylinder 1023 of the varnishing unit 1010 of the printing machine, the varnishing blanket cylinder being engaged with an impression cylinder of the printing machine.

FIG. 11*a* illustrates the varnishing blanket cylinder 1023 of the varnishing unit 1010 in section and on an enlarged scale, specifically in a form wherein it is suitable for applying varnish to the sheet 1040. The cylinder 1023 has a ribbed metal casting formed with a cylindrical outer surface that is interrupted at the location 1028 by a so-called cylinder or lock-up gap. In the exemplary embodiment shown, the cylinder gap 1028, for reasons which will be explained further hereinbelow, also has the approximate shape of a cylinder, but with a smaller diameter than that of the outer surface of the cylinder 1023. This need not be so, however; the significant factor alone is that the cylinder gap 1028 provides sufficient space for the installed fittings to pivot. In this portion of the varnishing blanket cylinder 1023 formed by the cylinder gap 1028, two clamping rails 1035 and 1036 are fastened on a support 1033 mounted thereat. On the clamping rails 1035 and 1036, the ends of the varnishing blanket 1025 are either gripped by clamping bars 1037 and 1038, as illustrated in FIG. 11*a*, or are hooked into grooves 1058 and 1059 formed in the clamping rails 1036 and 1037, respectively, depending upon the type of varnishing blanket that is used.

Figure 11B:
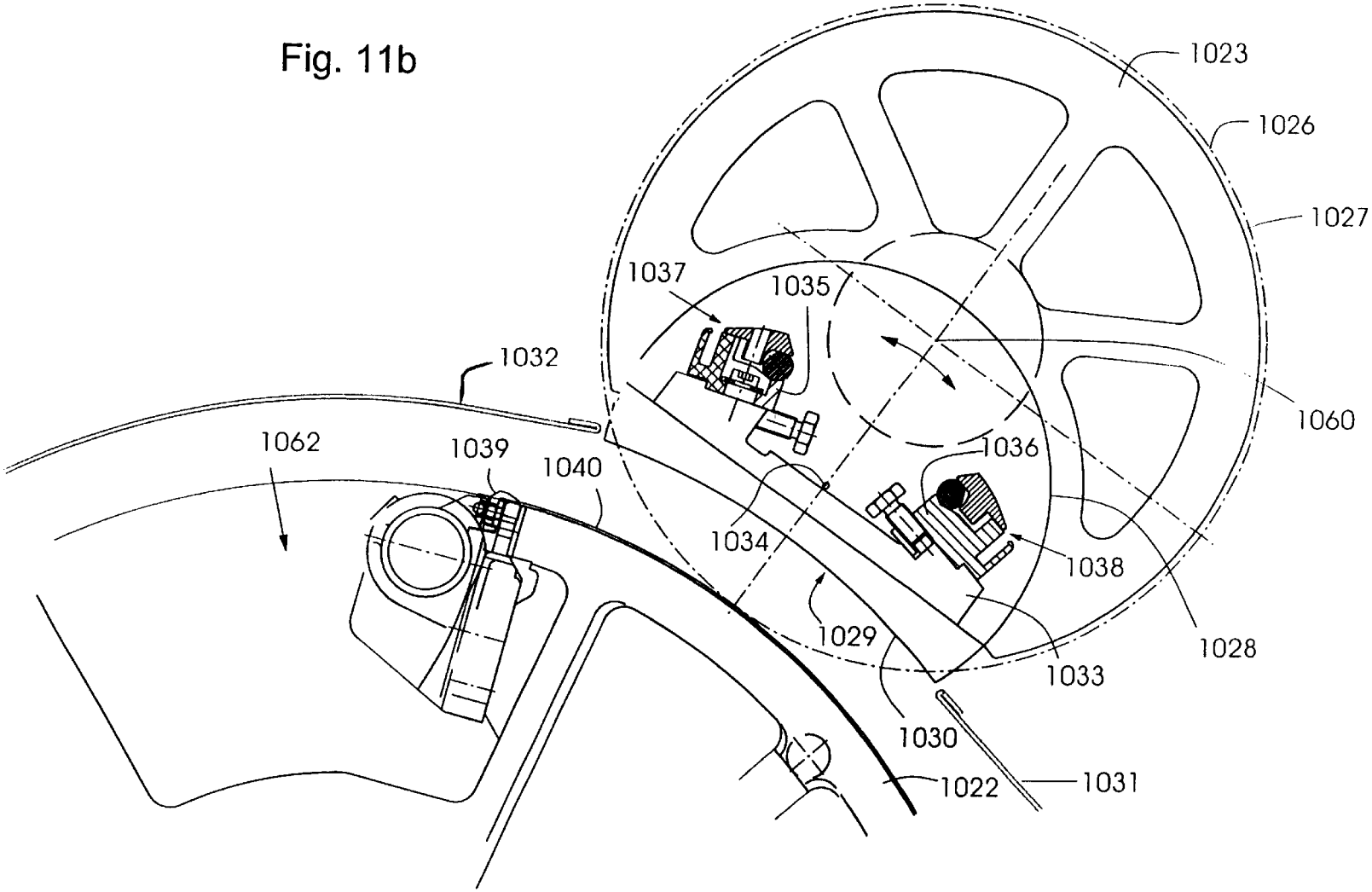
FIG. 11*b* is a view like that of FIG. 11*a* but with the varnishing blanket cylinder disengaged from or having been brought out of contact with the impression cylinder, the varnishing blanket having been removed from the varnishing blanket cylinder, and fittings installed in the cylinder gap having been pivoted out of the position thereof shown in FIG. 11*a;*
Figure 14:
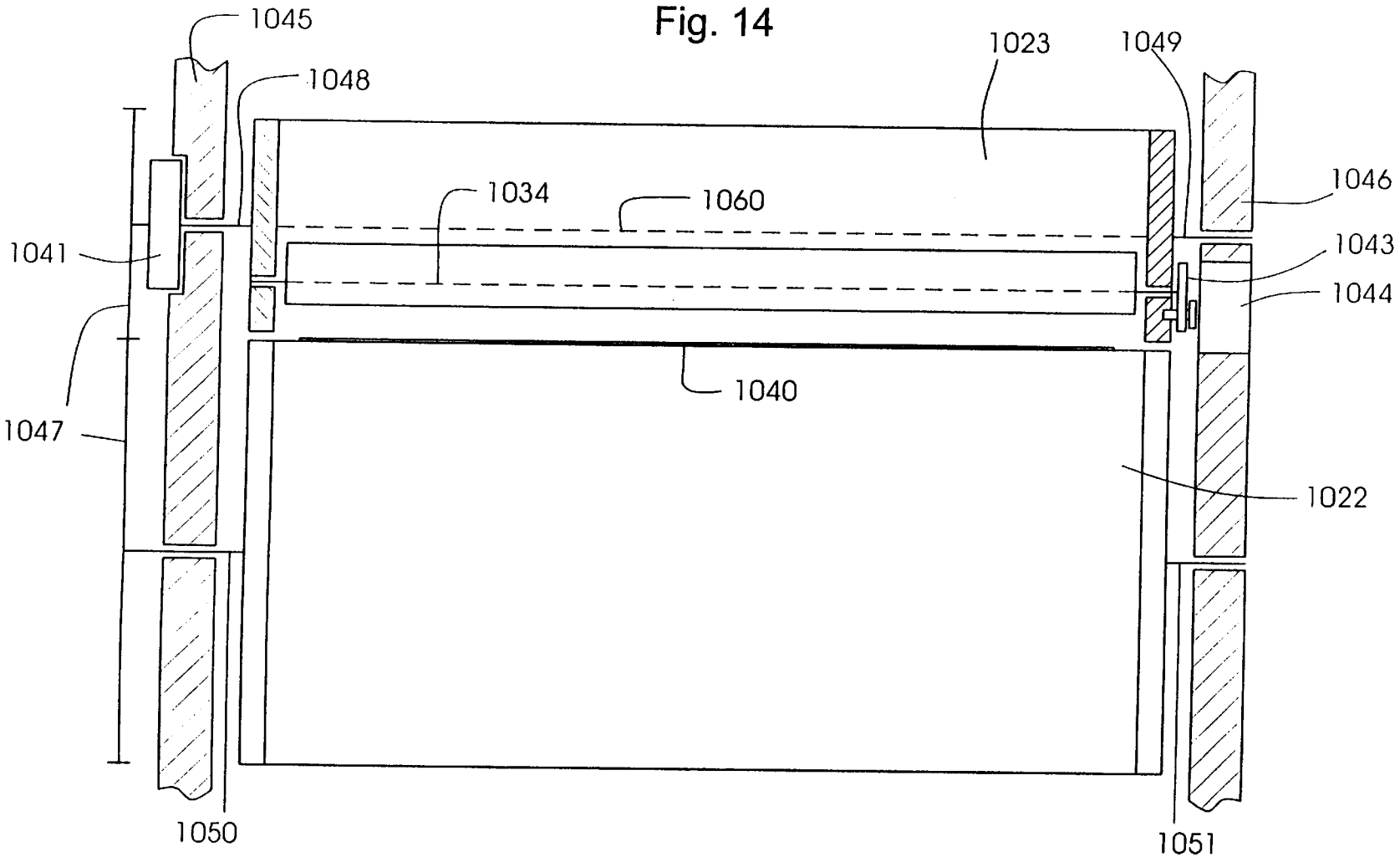
FIG. 14 is a highly diagrammatic longitudinal sectional view of the varnishing unit 1010 of FIG. 10 in the region of the printing nip between the varnishing blanket cylinder and the impression cylinder.

A support 1033 is mounted by appropriate axle journals in the two ends of the cylinder 1023 so as to be pivotable about an axis 1034. The purpose therefor is as follows:

If the sheet 1040, which is held on the impression cylinder 1022 by a gripper 1039 and has been printed with four colors in the units 1006 to 1009, is not to be varnished over the entire surface thereof, as sketched in FIG. 11*a*, it is conveyed through the nip between the impression cylinder 1022 and the varnishing blanket cylinder 1023, with the varnishing unit 1010 disengaged or brought out of contact, as will be explained hereinbelow with reference to FIG. 11*b*. In order to enlarge this nip as far as possible, when the main drive 1042 (note FIG. 9) of the printing machine 1001 is stopped in a position wherein the cylinder gap 1028 of the varnishing blanket cylinder 1023 is located opposite the cylinder gap 1062 of the impression cylinder 1022 (FIG. 11*a*), the installed gap fittings 1029, together with the support 1033, are pivoted about the axis 1034, after the cylinder 1023 has previously been disengaged or brought out of contact with the cylinder 1022, and the varnishing blanket 1026 has been removed. The drive to the cylinder 1023 is then disengaged from the drive train 1047 (note FIG. 14) of the printing machine 1001 via a clutch 1041. The cylinder 1023 then remains stationary in the position illustrated in FIG. 11*b*. In this case, a sheet guide element 1030 fastened to the underside of the support 1033 for the clamping rails 1035 and 1036 forms a bridge between two permanently installed sheet guide plates 1032 and 1031, which are arranged concentrically with the surface of the impression cylinder 1022.

The radius of the sheet guide element 1030 is somewhat longer than the radius of the cylinder 1022 and is located approximately concentrically opposite the latter. In the position drawn, wherein it is rotated through about 180°, the support 1033 is locked by a device 1043 shown in FIG. 14. The locking can be performed manually by operating personnel, as can the rotation of the installed cylinder fittings, through an opening 1044 (FIG. 14) in a side wall 1046 of the printing machine 1001, or if suitable actuators are provided, it can also be performed automatically, controlled by the printing machine. In the position shown in FIG. 11*b*, there is significantly more space between the sheet 1040 on the impression cylinder 1022 and the concentric surface of the sheet guide element 1030, than if the cylinder 1023 had simply been disengaged or brought out of contact with the cylinder 1022 as was previously usual, i.e., had simply been displaced by a total of about 2 mm, and the varnishing blanket had been removed. Because virtually a continuous, smooth matching surface results at a distance of a few centimeters from the sheet 1040, in addition due to the sheet guide element 1030 being provided instead of the installed channel fittings, in conjunction with the guide plates 1031 and 1032, the risk of smearing of the freshly printed surface of the sheet 1040 is virtually ruled out, even in the case of relatively stiff sheets such as cardboard or pasteboard, for example, which tends to lift off the impression cylinder 1022. This is because the continuous surface formed by the sheet guide plates and the sheet guide element then guides the lifted trailing edge of the sheet at the unprinted edge region thereof, so that it has no possibility of striking the printed locations anywhere.

In the above-described exemplary embodiment, the support 1033 is rotated or pivoted with the installed channel fittings 1029. Instead of displacing the installed channel fittings 1029 into the interior of the cylinder 1023 by pivoting, as described, it is also possible, however, as an alternative thereto, to remove the installed channel fittings 1029 completely, for example by disassembling the support 1033 from the cylinder gap 1028 and replacing it by an appropriately shaped sheet guide element 1030.

Figure 12:
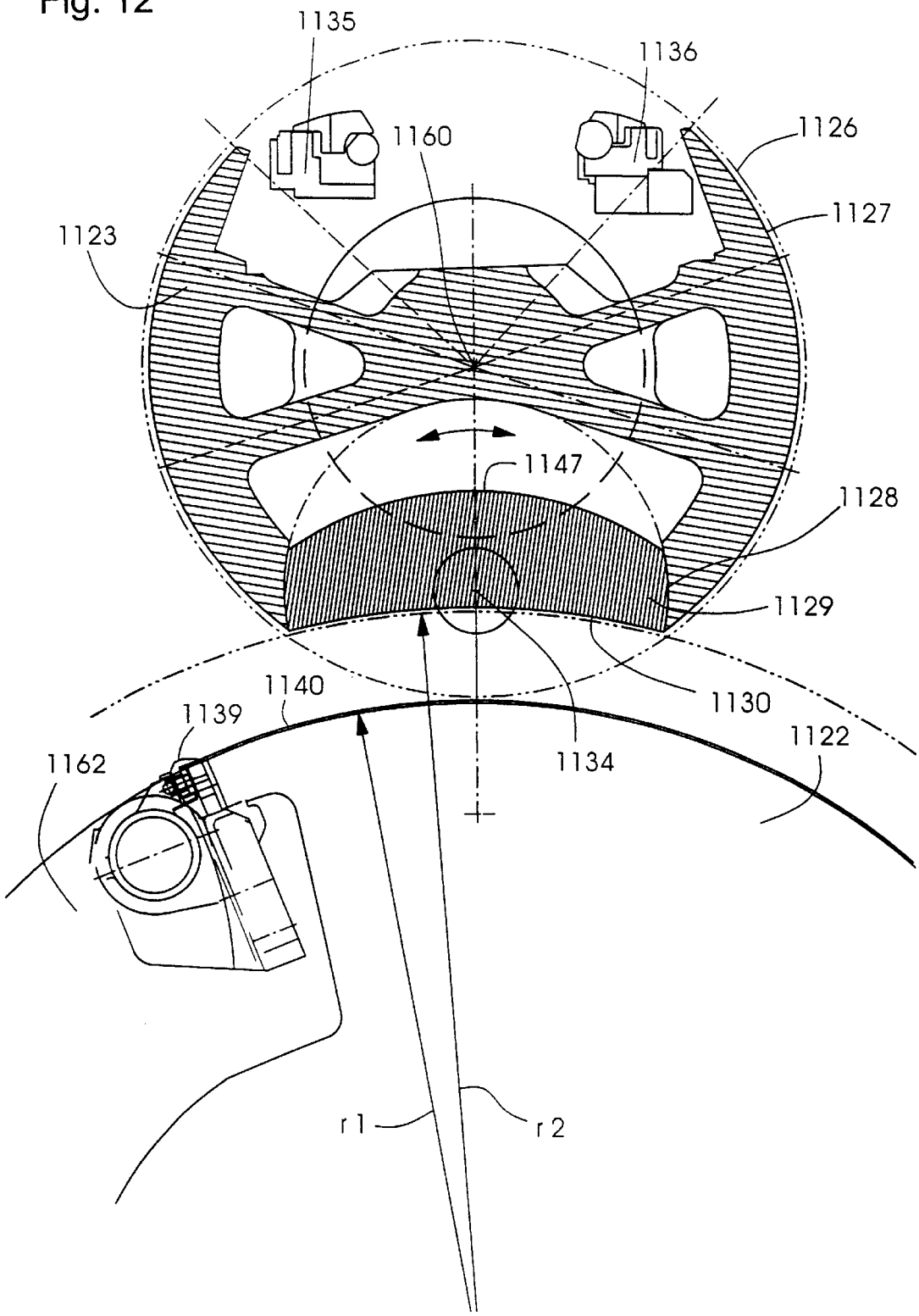
FIG. 12 is an enlarged fragmentary view of FIG. 10 showing in cross section a second exemplary embodiment of the varnishing blanket cylinder of the varnishing unit 1010.

A further alternative exemplary embodiment is illustrated in FIG. 12. Here, the installed cylinder fittings remain in the position which is usual for clamping the varnishing blanket 1126, and are permanently mounted thereat in the cylinder gap, respectively. Instead, a segment 1129 of the cylinder cover of the varnishing blanket cylinder 1123 is disposed so that it can pivot about an axis 1134 in a manner similar to that of the support plate 1033 in FIGS. 11*a* and 11*b*, the axis 1134 extending parallel to the axis 1160 of the cylinder 1123 and being arranged between the cylinder outer surface 1127 and the extension thereof, respectively, and the axis of rotation 1160 of the cylinder 1123. After the segment 1129 has been pivoted through 180°, the normally outer convex cylinder surface 1147 of the segment 1129 is displaced inwardly into a cavity 1128 formed in the cylinder 1123 and, instead, a concave sheet guide surface 1130 assumes its place on the other side of the segment 1129. The sheet guide surface 1130 is likewise again aligned with the radius r2 thereof concentric with the radius r1 of the surface of the impression cylinder 1122, and the rather great distance between the surfaces of the impression cylinder and the varnishing blanket cylinder, achievable by the difference between the respective radii r1 and r2, ensures that the sheet 1140 transported without any application of varnish passes through the varnishing unit. Otherwise, like parts shown in FIG. 12 are identified by the same reference numeral as in FIGS. 11*a* and 11*b* increased by 100, and will not be explained or described again at this juncture. It is believed to be quite clear that the individual steps up to the positioning of the cylinder 1123 in the position shown in FIG. 12 are like those relating to the positioning of the cylinder 1023 in FIGS. 11*a* and 11*b*.

Figure 13:
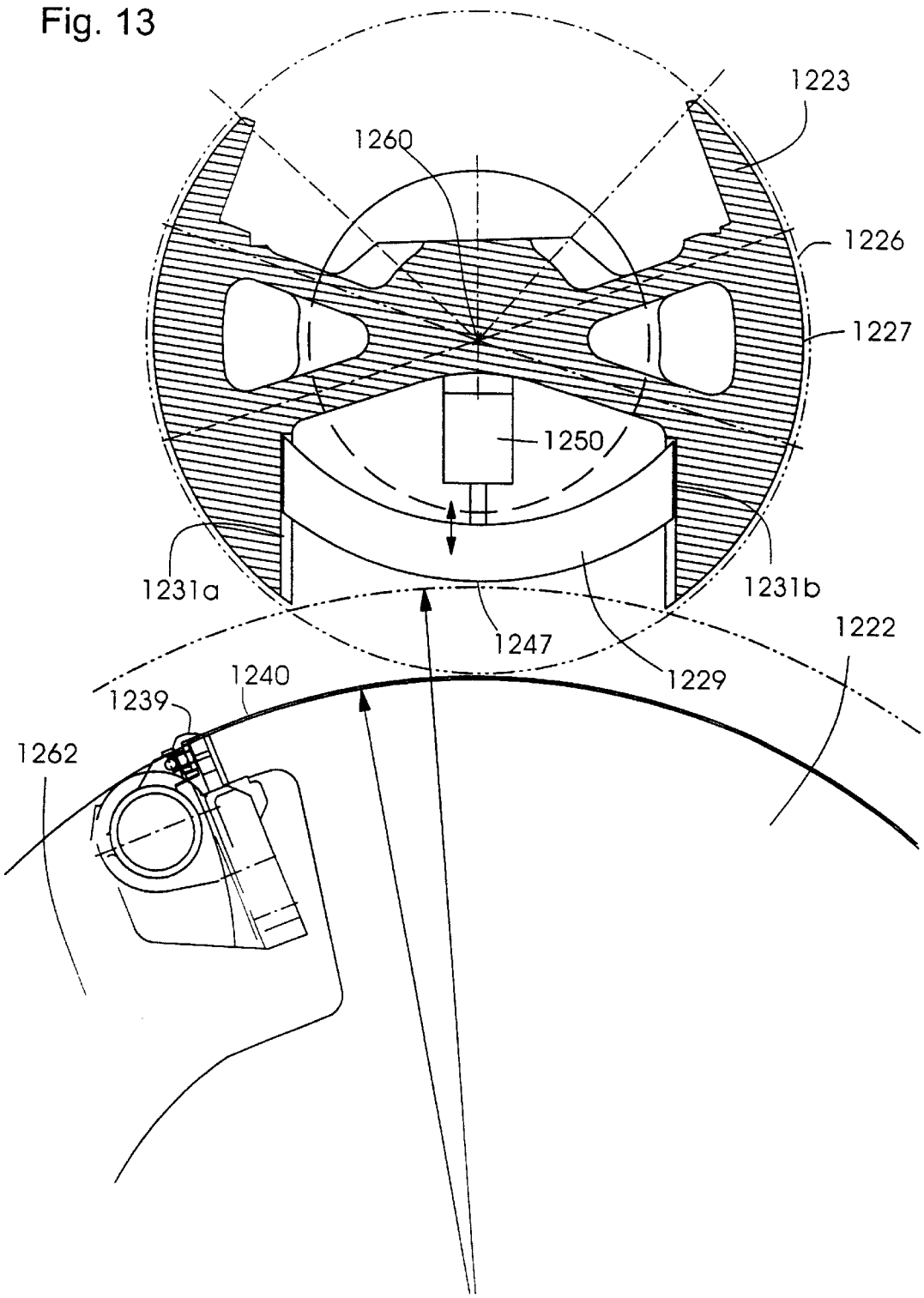
FIG. 13 is an enlarged fragmentary view of FIG. 10 showing in cross section a third exemplary embodiment of the varnishing blanket cylinder of the varnishing unit 1010.

In addition, the segment 1129 can also be displaced in any other way in order to create space between sheet and varnishing blanket cylinder, specifically as illustrated in FIG. 13, for example. Herein, the segment 1229 of the cylinder outer surface 1227 of the varnishing blanket cylinder 1223 is withdrawn or retracted several centimeters into the interior of the cylinder 1223 with the aid of linear guides 1231*a* and 1231*b*, specifically using an actuator 1240, for example, in the form of a geared motor, which is driven from the operating console of the printing machine 1001 in response to an appropriate command. This applies as well to the support plate 1033 in the exemplary embodiment according to FIGS. 11*a* and 11*b*, i.e., in that it too can be rotated through 180° by a motor.

In the foregoing exemplary embodiments, the invention has been illustrated with reference to the varnishing unit 1010 of the printing machine 1001 according to FIG. 9. In a like manner, however, when one of the printing units 1007, 1008 or 1009 is stopped, it is also possible to have the sheet, for example, printed in the printing unit 1006 pass through without smearing, by carrying out the measures described for the varnishing blanket cylinder 1023 instead or additionally also for the rubber blanket cylinder 1015 in the relevant printing units as well.

Figure 15:
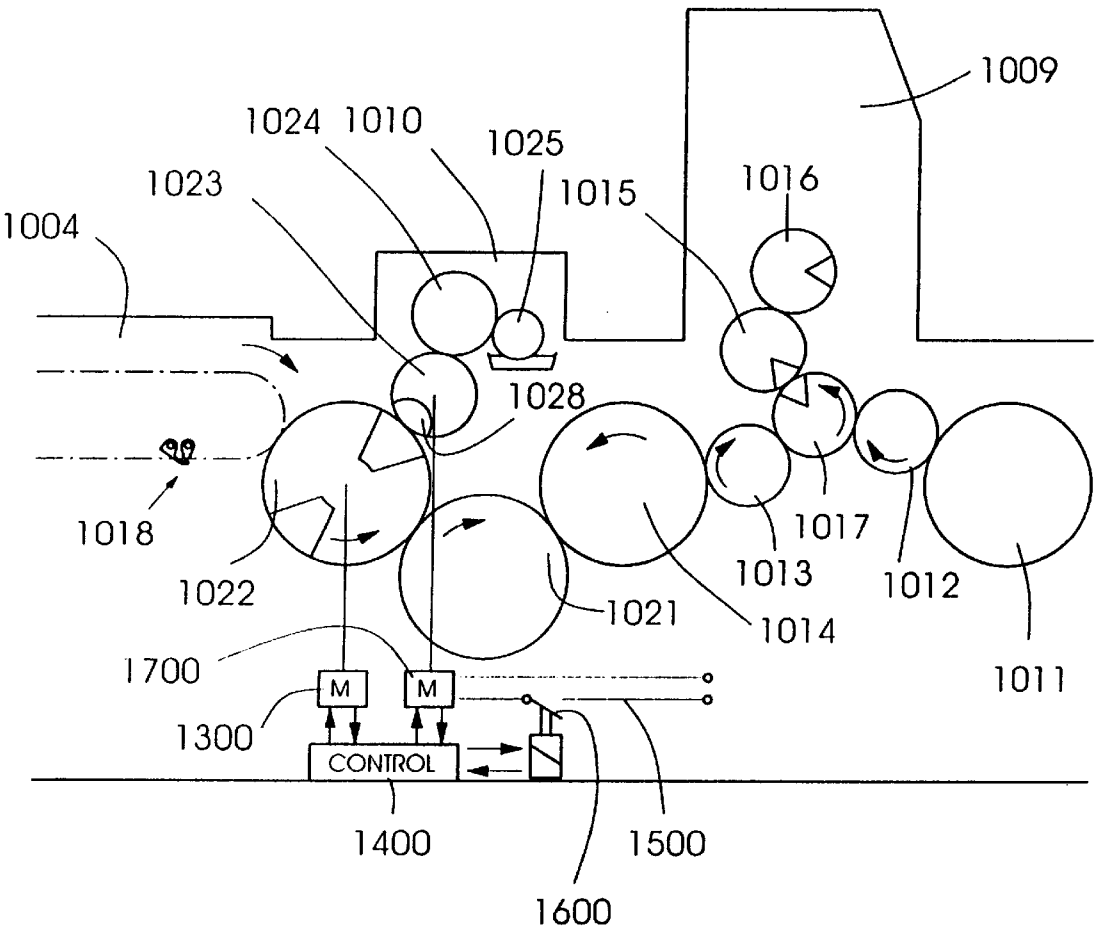
FIG. 15 is a fragmentary view of the printing machine of FIG. 10 showing the units 1009 and 1010 of the printing machine with cylinders used for paper transport and for printing, respectively, and having a drive that is modified with respect to the embodiment shown in FIG. 10.

FIG. 15 illustrates a version of the printing machine similar to the one shown in FIG. 10 which has been modified with regard to the drive technology.

The parts in FIG. 15 which have already been described with respect to FIG. 10 and which are indicated by corresponding reference numerals need not be described again.

In the modified embodiment shown in FIG. 15, the impression cylinder 1022 is driven, such that it is rotated, by a first electric motor 1300, while a second electric motor 1700 drives the cylinder 1023 such that it is rotated. An electronic control device 1400 is connected to the two motors 1300, 1700 such that it performs a control. The electronic control device 1400 controls the rotational speed of the two motors 1300, 1700 in a synchronous manner such that the circumferential surfaces of the cylinders 1022, 1023 roll on each other without slippage or skid. The first motor 1300 is the main drive motor of the printing press 1001 and drives the sheetguiding cylinders 1021, 1022 of the printing press such that they rotate. The sheetguiding cylinders 1021, 1022 are drive-connected via a spur gear or cylinder gear. The second, separate motor 1700 is a so-called direct drive of the cylinder 1023 and makes a mechanical clutch or coupling device unnecessary.

In order to stop the rotation of the cylinder 1023, a breaker, for example an electromagnetically actuated switch, is opened so that a current circuit 1500, which supplies electric energy to the second motor 1700, is interrupted.

When the breaker 1600, which is provided in the current circuit 1500, is in a closed position, the second motor 1700 rotates and consequently the cylinder 1023 rotates. Due to the electronic drive coupling between the cylinder 1023 and the impression cylinder 1022, it is no longer necessary to mechanically couple the cylinder 1023 and 1022 via a gear train.

We claim:

1. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set;

said additional cylinder being a stoppable cylinder configured such that said additional cylinder is stoppable when said impression cylinder rotates;

said additional cylinder being formed with a cylinder gap approximately alignable with said impression cylinder in a stopped condition of said additional cylinder, for setting the spaced distance between said additional cylinder and said impression cylinder; and a detent for fixing said additional cylinder relative to a printing-press frame, in a position of said additional cylinder wherein said cylinder gap formed therein is in alignment with said impression cylinder, and in a condition wherein said additional cylinder is decoupled from a printing-press drive for driving said additional cylinder.

2. The sheet-fed rotary printing press according to claim 1, including a clutch via which said additional cylinder is decouplable from a printing-press drive for driving said additional cylinder.

3. The sheet-fed rotary printing press according to claim 1, wherein said at least one unit is disposed downline from at least one printing unit of a sheet-fed rotary printing press, as viewed in a sheet transport direction therethrough.

4. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set;

said additional cylinder being a stoppable cylinder configured such that said additional cylinder is stoppable when said impression cylinder rotates;

said additional cylinder being formed with a cylinder gap approximately alignable with said impression cylinder in a stopped condition of said additional cylinder, for setting the spaced distance between said additional cylinder and said impression cylinder; and a blast air connection for fixing said additional cylinder relative to a printing-press frame, in a position of said additional cylinder wherein said cylinder gap formed therein is in alignment with said impression cylinder, and in a condition wherein said additional cylinder is decoupled from a printing-press drive for driving said additional cylinder.

5. The sheet-fed rotary printing press according to claim 4, including a clutch via which said additional cylinder is decouplable from a printing-press drive for driving said additional cylinder.

6. The sheet-fed rotary printing press according to claim 4, wherein said at least one unit is disposed downline from at least one printing unit of a sheet-fed rotary printing press, as viewed in a sheet transport direction therethrough.

7. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set;

said sheet guiding device including at least one sheet guiding element secured to said additional cylinder; and said additional cylinder having a displaceable outer portion, said sheet guiding element being disposed at said displaceable outer portion.

8. The sheet-fed rotary printing press according to claim 7, wherein said additional cylinder is configured to be stoppable in a position wherein said displaceable outer portion thereof is disposed opposite said impression cylinder.

9. The sheet-fed rotary printing press according to claim 7, wherein said displaceable outer portion of said additional cylinder has a clamping device for a cylinder covering to be mounted on said additional cylinder.

10. The sheet-fed rotary printing press according to claim 7, wherein said displaceable outer portion of said additional cylinder forms part of a circular outer surface of said additional cylinder.

11. The sheet-fed rotary printing press according to claim 7, wherein said displaceable outer portion of said additional cylinder is removably fastened to said additional cylinder.

12. The sheet-fed rotary printing press according to claim 7, wherein said displaceable outer portion of said additional cylinder is displaceable into an interior of said additional cylinder.

13. The sheet-fed rotary printing press according to claim 12, wherein said displaceable outer portion of said additional cylinder is mounted so as to be pivotable about an axis aligned parallel to an axis of rotation of said additional cylinder.

14. The sheet-fed rotary printing press according to claim 12, wherein said displaceable outer portion of said additional cylinder is displaceable linearly in a direction towards the interior of said additional cylinder.

15. The sheet-fed rotary printing press according to claim 13, wherein said sheet guiding element is an outwardly pivotable sheet guiding element.

16. The sheet-fed rotary printing press according to claim 15, wherein said sheet guiding element is formed with a surface which, when in an outwardly displaced position, extends concentrically with a surface of said impression cylinder.

17. The sheet-fed rotary printing press according to claim 7, wherein said additional cylinder is formed with a cylinder gap, and wherein said sheet guiding element is received in said cylinder gap.

18. The sheet-fed rotary printing press according to claim 7, wherein at least one cylinder of said impression cylinder and said additional cylinder is constructed so as to be engageable with and disengageable from a respective other one of said impression cylinder and said additional cylinder for setting the spaced distance between said impression cylinder and said additional cylinder.

19. The sheet-fed rotary printing press according to claim 1, wherein said at least one unit is disposed downline from at least one printing unit of a sheet-fed rotary printing press, as viewed in a sheet transport direction therethrough.

20. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set; and said sheet guiding device including at least one sheet guiding element secured to said additional cylinder, said sheet guiding element being formed as at least one small wheel.

21. The sheet-fed rotary printing press according to claim 20, wherein said additional cylinder is formed with a cylinder gap, and wherein said sheet guiding element is received in said cylinder gap.

22. The sheet-fed rotary printing press according to claim 20, wherein at least one cylinder of said impression cylinder and said additional cylinder is constructed so as to be engageable with and disengageable from a respective other one of said impression cylinder and said additional cylinder for setting the spaced distance between said impression cylinder and said additional cylinder.

23. The sheet-fed rotary printing press according to claim 20, wherein said at least one unit is disposed downline from at least one printing unit of a sheet-fed rotary printing press, as viewed in a sheet transport direction therethrough.

24. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set;

said impression cylinder and said additional cylinder, between which the spaced distance is set, rotating in synchronism while said sheet guiding device acts upon a sheet to be printed;

said sheet guiding device including blast air nozzles disposed on a circumferential surface of said additional cylinder; and said additional cylinder having a stationary cylinder core formed with a chamber chargeable with blast air, and an outer casing rotatable about said stationary cylinder core, said outer casing having blast air ducts leading to said blast air nozzles.

25. The sheet-fed rotary printing press according to claim 24, wherein said at least one unit is disposed downline from at least one printing unit of a sheet-fed rotary printing press, as viewed in a sheet transport direction therethrough.

26. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set;

said impression cylinder and said additional cylinder, between which the spaced distance is set, rotating in synchronism while said sheet guiding device acts upon a sheet to be printed;

said sheet guiding device including blast air nozzles disposed on a circumferential surface of said additional cylinder; and a rotary valve operatively connected to said additional cylinder and, upon rotation of said additional cylinder, intermittently subjecting said blast air nozzles to blast air whenever said blast air nozzles are directed substantially towards said impression cylinder.

27. The sheet-fed rotary printing press according to claim 26, wherein said at least one unit is disposed downline from at least one printing unit of a sheet-fed rotary printing press, as viewed in a sheet transport direction therethrough.

28. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set; and said at least one unit being a printing unit, and said additional cylinder being a printing cylinder for printing on a sheet to be printed.

29. The sheet-fed rotary printing press according to claim 28, wherein said at least one unit is disposed downline from at least one printing unit of a sheet-fed rotary printing press, as viewed in a sheet transport direction therethrough.

30. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set; and said at least one unit being a varnishing unit, and said additional cylinder being a varnishing cylinder for varnishing a sheet to be printed.

31. The sheet-fed rotary printing press according to claim 30, wherein said at least one unit is disposed downline from at least one printing unit of a sheet-fed rotary printing press, as viewed in a sheet transport direction therethrough.

32. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set; and said at least one unit being a finishing unit, and said additional cylinder being a processing cylinder having a circumference occupied by tools for processing a sheet to be printed.

33. The sheet-fed rotary printing press according to claim 32, wherein said at least one unit is disposed downline from at least one printing unit of a sheet-fed rotary printing press, as viewed in a sheet transport direction therethrough.

34. A sheet-fed rotary printing press, comprising:

at least one unit including an impression cylinder and an additional cylinder;

said impression cylinder and said additional cylinder being relatively adjustable a spaced distance from one another;

a sheet guiding device disposed on said additional cylinder, said sheet guiding device being configured to keep sheets of printing material, which have been transported by said impression cylinder past said additional cylinder, away from said additional cylinder, once the spaced distance between said impression cylinder and said additional cylinder has been set;

a first electric motor drive-connected to said impression cylinder for rotating said impression cylinder; and a second electric motor drive-connected to said additional cylinder for rotating said additional cylinder.

35. The sheet-fed rotary printing press according to claim 34, wherein said at least one unit is disposed downline from at least one printing unit of a sheet-fed rotary printing press, as viewed in a sheet transport direction therethrough.

36. The sheet-fed rotary printing press according to claim 34, including:

an electronic control device connected to said first and second electrical motors; and said electronic control device controlling said first electric motor such that said first electric motor rotates said impression cylinder with a first circumferential surface speed, and said electronic control device controlling said second electric motor such that said second electric motor simultaneously rotates said additional cylinder with a second circumferential surface speed equal to the first circumferential surface speed.

37. The sheet-fed rotary printing press according to claim 34, including:

a current circuit including an integrated breaker for interrupting said current circuit; and said additional cylinder and said impression cylinder being controlled such that, when said breaker interrupts said current circuit, said additional cylinder is shut down and stopped while said impression cylinder rotates.

38. A sheet-fed rotary printing press, comprising:

at least one upstream printing unit and at least one sheet processing unit downstream of said at least one upstream printing unit;

said at least one sheet processing unit including an impression cylinder, an additional cylinder and a sheet guiding device, said additional cylinder being a cylinder selected from the group consisting of a coating cylinder, a printing cylinder, a varnishing cylinder, and a finishing cylinder;

said additional cylinder having a cylinder gap formed therein;

at least one of said impression cylinder and said additional cylinder being configured for providing a setting of a spaced distance between said impression cylinder and said additional cylinder;

said sheet guiding device being disposed in said cylinder gap of said additional cylinder;

said at least one sheet processing unit having a first mode of operation and a second mode of operation, one of said modes of operation being selected by an operator of the printing press;

said additional cylinder being used in each of said modes of operation;

in said first mode of operation said additional cylinder being in rotational contact with a first sheet freshly printed in said at least one upstream printing unit and transported by said impression cylinder, and forming together with said impression cylinder a sheet processing nip;

in said first mode of operation the first sheet being processed in the sheet processing nip by one of a coating of the first sheet, printing of the first sheet, varnishing of the first sheet or finishing of the first sheet;

in said second mode of operation said additional cylinder being used for guiding a second sheet freshly printed in said at least one upstream printing unit by said sheet guiding device; and in said second mode of operation the second sheet being transported by said impression cylinder past said additional cylinder and, simultaneously, said sheet guiding device keeping the second sheet away from said additional cylinder.

39. The sheet-fed rotary printing press according to claim 38, wherein said sheet guiding device is formed as at least one blast tube.

40. The sheet-fed rotary printing press according to claim 39, wherein said blast tube is couplable to a blast air connection at an end face of said additional cylinder.

41. The sheet-fed rotary printing press according to claim 38, wherein said sheet guiding device is formed as at least one guide tongue.

42. A sheet-fed rotary printing press, comprising:

at least one upstream printing unit and at least one sheet processing unit downstream of said at least one upstream printing unit;

said at least one sheet processing unit including an impression cylinder, an additional cylinder and a sheet guiding element;

said additional cylinder having a cylinder gap formed therein;

said sheet guiding element being disposed in said cylinder gap;

said at least one sheet processing unit having a first mode of operation and a second mode of operation, one of said modes of operation being selected by an operator of the printing press;

said additional cylinder being used in each of said modes of operation;

in said first mode of operation said additional cylinder being in rotational contact with a first sheet freshly printed in said at least one upstream printing unit and transported by said impression cylinder, and forming together with said impression cylinder a sheet processing nip;

in said second mode of operation said additional cylinder being fixed in a non-rotating position of said additional cylinder such that said cylinder gap is in alignment with said impression cylinder;

in said second mode of operation said sheet guiding element being used for guiding a second sheet freshly printed in said at least one upstream printing unit; and in said second mode of operation the second sheet being transported by said impression cylinder past said additional cylinder and, simultaneously, said sheet guiding element keeping the second sheet away from said additional cylinder.

43. The sheet-fed rotary printing press according to claim 42, wherein said sheet guiding element is formed as at least one blast tube.

44. The sheet-fed rotary printing press according to claim 43, wherein said blast tube is couplable to a blast air connection at an end face of said additional cylinder.

45. The sheet-fed rotary printing press according to claim 42, wherein said sheet guiding element is formed as at least one guide tongue.

46. The sheet-fed rotary printing press according to claim 42, wherein said additional cylinder is a cylinder selected from the group consisting of a coating cylinder, a printing cylinder, a varnishing cylinder, and a finishing cylinder.

47. The sheet-fed rotary printing press according to claim 42, wherein at least one of said impression cylinder and said additional cylinder are configured for providing a setting of a spaced distance between said impression cylinder and said additional cylinder.

* * * * *